US008373354B2

(12) United States Patent
Han et al.

(10) Patent No.: US 8,373,354 B2
(45) Date of Patent: Feb. 12, 2013

(54) BACKLIGHT UNIT DRIVER

(75) Inventors: Sang Kyoo Han, Seoul (KR); Sung Soo Hong, Seoul (KR); Chung Wook Roh, Seoul (KR); Sang Gab Park, Gyunggi-do (KR); Kyu Min Park, Seoul (KR); Young Seung Roh, Gyunggi-do (KR); Heung Gyoon Choi, Gyunggi-do (KR); Nam Jin Park, Gyunggi-do (KR)

(73) Assignee: Samsung Electro-Mechanics, Co., Ltd., Gyunggi-do (KR)

( * ) Notice: Subject to any disclaimer, the term of this patent is extended or adjusted under 35 U.S.C. 154(b) by 186 days.

(21) Appl. No.: 13/022,030

(22) Filed: Feb. 7, 2011

(65) Prior Publication Data

US 2011/0204804 A1 Aug. 25, 2011

(30) Foreign Application Priority Data

Feb. 23, 2010 (KR) ..... 10-2010-0016131

(51) Int. Cl.
*H05B 41/16* (2006.01)

(52) U.S. Cl. ..... 315/276; 315/224; 315/299

(58) Field of Classification Search ..... 315/209 R, 315/219, 224, 250, 276, 291, 294, 299
See application file for complete search history.

(56) References Cited

U.S. PATENT DOCUMENTS 6,936,975 B2 * 8/2005 Lin et al. ..... 315/224
8,179,053 B2 * 5/2012 Lin et al. ..... 315/224
8,222,836 B2 * 7/2012 Jin ..... 315/307

FOREIGN PATENT DOCUMENTS

KR 1020080084028 A 9/2008

* cited by examiner

*Primary Examiner* — Thuy Vinh Tran
(74) *Attorney, Agent, or Firm* — Lowe, Hauptman, Ham & Berner, LLP

(57) ABSTRACT

There is provided a backlight unit driver capable of driving multi-channel lamps of a backlight unit, especially LED lamps, by supplying a driving power to the lamps using a single transformer and maintaining the current balance of the driving power supplied to each of the lamps.

13 Claims, 4 Drawing Sheets

BACKLIGHT UNIT DRIVER

CROSS-REFERENCE TO RELATED APPLICATIONS

This application claims the priority of Korean Patent Application No. 10-2010-0016131 filed on Feb. 23, 2010, in the Korean Intellectual Property Office, the disclosure of which is incorporated herein by reference.

BACKGROUND OF THE INVENTION

1. Field of the Invention

The present invention relates to a backlight unit driver, and more particularly, to a backlight unit driver capable of driving multi-channel lamps of a backlight unit, especially light emitting diode lamps, by supplying a driving power to the lamps using a single transformer and maintaining the current balance of the driving power supplied to each of the lamps.

2. Description of the Related Art

In recent years, flat panel display (FPD) devices, reflecting the user's demand for high resolution, large-sized screens and the like, have been replacing display devices using a cathode ray tube (CRT) in the display industry.

Particularly, in the case of a large-sized display device, a Liquid Crystal Display (LCD) device has shown rapid growth due to advantages such as a smaller-size and a lighter-weight in comparison to other display devices, and such an LCD device is being expected to grow in prominence henceforth, in view of price and marketability.

Meanwhile, a Cold Cathode Fluorescent Lamp (CCFL) has been used as a backlight light source in a conventional LCD device. In recent years, however, the use of a Light Emitting Diode (LED) lamp has been gradually increased due to various advantages including power consumption, life span and environmentally friendly characteristics.

In the case that such an LED lamp is used as a backlight light source of an LCD device, the constant current control of the LED lamp in each channel should be ensured in order to guarantee uniformity of brightness throughout the entirety of a screen.

To enable this, each LED lamp according to the related art employs a direct current-direct current (DC-DC) converter, in which the DC-DC converter converts an input DC power into a driving power and supplies the converted power to the LED lamp, so that the current flowing through each LED lamp may be precisely controlled. In this case, however, as many DC-DC converters and controllers are required as the number of LED lamps. This leads to problems such as an increase in production costs as well as in the volume of an LED lamp driver, and a reduction in power conversion efficiency because of the plurality of DC-DC converters as well as in reliability because of an active element, an integrated circuit or the like applied to the DC-DC converters.

SUMMARY OF THE INVENTION

An aspect of the present invention provides a backlight unit driver capable of driving multi-channel lamps of a backlight unit, especially light emitting diode lamps, by supplying a driving power to the lamps using a single transformer and maintaining the current balance of the driving power supplied to each of the lamps.

According to an aspect of the present invention, there is provided a backlight unit driver including: an inverter part switching an input power to supply a power having a preset cycle; a lamp part including a plurality of lamps receiving the switched power from the inverter part and emitting light; and a current balance part electrically connected between the inverter part and the lamp part and transmitting the switched power from the inverter part to the plurality of lamps of the lamp part such that a half cycle power of the switched power is transmitted to odd-numbered lamps of the lamp part and the other half cycle power of the switched power is transmitted to even-numbered lamps of the lamp part to maintain current balance according to a charge balance law between the half cycle power and the other half cycle power of the switched power.

The current balance part may include a single transformer including a primary winding receiving the switched power from the inverter part and a plurality of secondary windings each receiving the switched power from the primary winding by electromagnetic coupling with the primary winding and transmitting the received power to a corresponding lamp; and a plurality of capacitors maintaining current balance according to the charge balance law by being electrically connected to the plurality of secondary windings, respectively.

The backlight unit driver may further include a path supply part supplying a conductive path for a power transmitted from the current balance part to the plurality of lamps of the lamp part according to a half cycle of the switched power from the inverter part.

The path supply part may include a first diode group including a plurality of diodes each having a cathode connected to one end of a corresponding lamp among the plurality of lamps of the lamp part; a second diode group being in one-to-one correspondence with the plurality of diodes of the first diode group and including a plurality of diodes each having a cathode connected to an anode of a corresponding diode among the plurality of diodes of the first diode group; and a third diode group being in one-to-one correspondence with the plurality of diodes of the second diode group and including a plurality of diodes each having a cathode connected to an anode of a corresponding diode among the plurality of diodes of the second diode group and an anode connected to a ground.

An odd-numbered secondary winding, among the plurality of secondary windings of the single transformer, may be electrically connected between an anode of the same odd-numbered diode as the odd-numbered secondary winding and an anode of an even-numbered diode subsequent to the odd-numbered diode among the plurality of diodes of the first diode group. An even-numbered secondary winding, among the plurality of secondary windings of the single transformer, may be electrically connected between an anode of the same even-numbered diode as the even-numbered secondary winding and an anode of an odd-numbered diode subsequent to the even-numbered diode among the plurality of diodes of the second diode group. A final secondary winding, among the plurality of secondary windings of the single transformer, may be electrically connected between an anode of a final diode and an anode of a first diode among the plurality of diodes of the second diode group.

A first secondary winding, among the plurality of secondary windings of the single transformer, may be electrically connected between an anode of a first diode and an anode of a second diode among the plurality of diodes of the first diode group. A second secondary winding, among the plurality of secondary windings of the single transformer, may be electrically connected between an anode of a second diode and an anode of a third diode among the plurality of diodes of the second diode group. A third secondary winding, among the plurality of secondary windings of the single transformer, may be electrically connected between an anode of a third diode and an anode of a fourth diode among the plurality of diodes of the first diode group. A fourth secondary winding, among the plurality of secondary windings of the single transformer, may be electrically connected between an anode of a fourth diode and an anode of a first diode among the plurality of diodes of the second diode group.

An odd-numbered capacitor among the plurality of capacitors may be electrically connected between one end of the same odd-numbered secondary winding as the odd-numbered capacitor and an anode of an even-numbered diode subsequent to the odd-numbered secondary winding of the first diode group. An even-numbered capacitor among the plurality of capacitors may be electrically connected between one end of the same even-numbered secondary winding as the even-numbered capacitor and an anode of an odd-numbered diode subsequent to the even-numbered secondary winding of the second diode group. A final capacitor of the plurality of capacitors may be electrically connected between one end of the final secondary winding and the anode of the first diode of the second diode group.

A first capacitor among the plurality of capacitors may be electrically connected between one end of the first secondary winding and the anode of the second diode of the first diode group. A second capacitor among the plurality of capacitors may be electrically connected between one end of the second secondary winding and the anode of the third diode of the second diode group. A third capacitor among the plurality of capacitors may be electrically connected between one end of the third secondary winding and the anode of the fourth diode of the first diode group. A fourth capacitor among the plurality of capacitors may be electrically connected between one end of the fourth secondary winding and the anode of the first diode of the second diode group.

The primary winding and the plurality of secondary windings of the single transformer may have the same winding start point.

The inverter part may switch the input power in a half-bridge, push-pull, or full-bridge configuration.

The backlight unit driver may further include a rectification part rectifying a common alternating current (AC) power, and a power factor correction (PFC) part correcting a power factor of the rectified power and supplying the corrected power to the inverter part as the input power.

The plurality of lamps of the lamp part may be in even number. The plurality of secondary windings of the single transformer may be in even number.

The plurality of lamps of the lamp part may be light emitting diodes (LEDs).

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
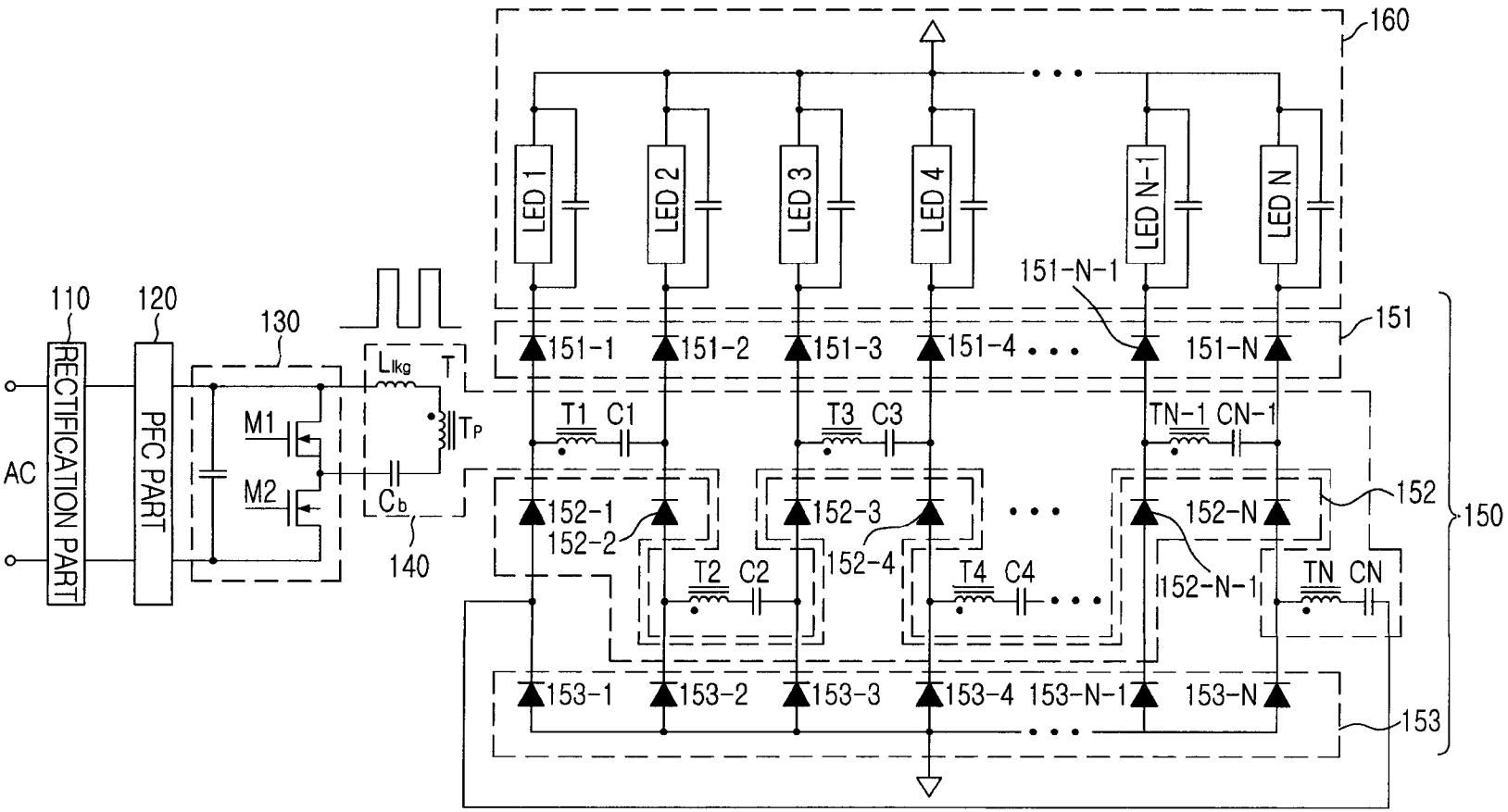
FIG. 1 schematically illustrates the configuration of a backlight unit driver according to an exemplary embodiment of the present invention.

FIG. 1 schematically illustrates the configuration of a backlight unit driver according to an exemplary embodiment of the present invention.

With reference to FIG. 1, a backlight unit driver 100 according to an exemplary embodiment of the invention may include an inverter part 130, a current balance part 140, a path supply part 150, and a lamp part 160. The backlight unit driver 100 may further include a rectification part 110 and a power factor correction (PFC) part 120.

The rectification part 110 may rectify and smooth a common alternating current (AC) power.

The PFC part 120 may correct a power factor by adjusting a phase difference between the current and voltage of the power rectified and smoothed by the rectification part 110. The power corrected by the PFC part 120 may be inputted to the inverter part 130.

The inverter part 130 may switch the corrected direct current (DC) power inputted from the PFC part 120 to be converted into AC power. The inverter part 130 may have two series-connected switches M1 and M2 in a half-bridge configuration. However, the inverter part 130 may be embodied in various configurations.

Figure 4A:
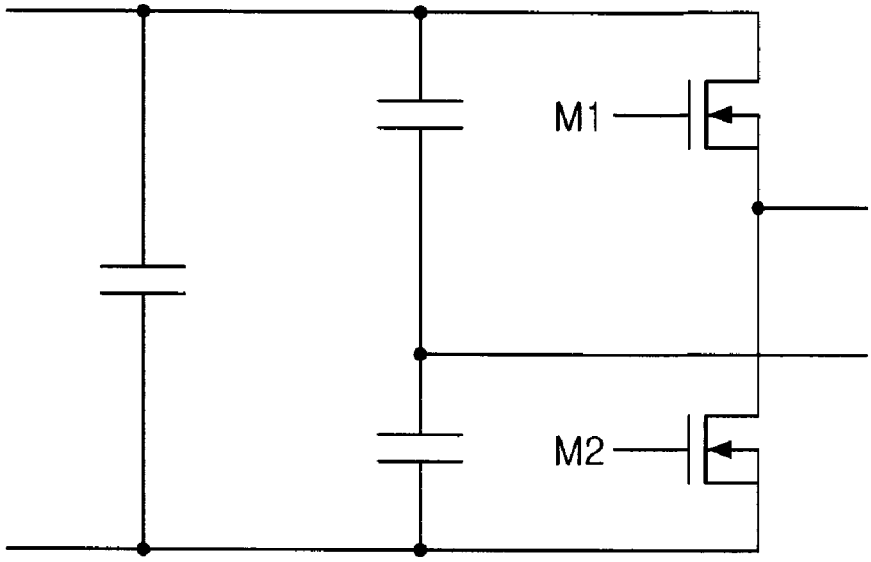
FIGS. 4A and 4B illustrate the configuration of an inverter part employed in a backlight unit driver according to an exemplary embodiment of the present invention.
Figure 4B:
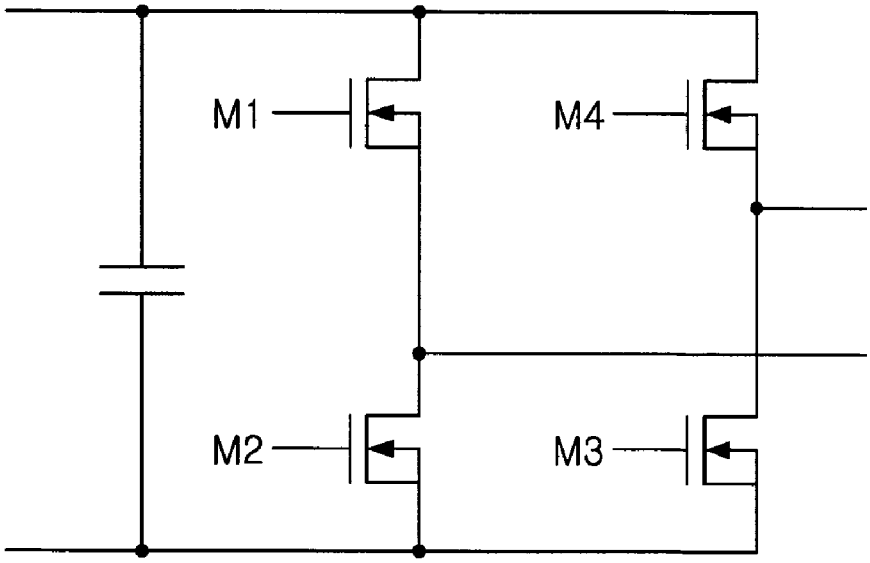

FIGS. 4A and 4B illustrate the configuration of an inverter part employed in a backlight unit driver according to an exemplary embodiment of the present invention.

With reference to FIGS. 4A and 4B, the inverter part 130 employed in the backlight unit driver of the present invention may have two switches M1 and M2 in a push-pull configuration or four switches M1, M2, M3 and M4 in a full-bridge configuration.

The power switched from the inverter part 130 may be transmitted to the current balance part 140.

The current balance part 140 may include a single transformer T and a plurality of capacitors C1 to CN.

The transformer T may include a single primary winding Tp and a plurality of secondary windings T1 to TN.

The primary winding Tp may receive the switched power from the inverter part 130. Here, the switched power from the inverter part 130 is AC power, so its cycle may be formed of a positive half-cycle and a negative half-cycle.

The plurality of secondary windings T1 to TN may receive the power from the primary winding Tp according to a preset winding ratio therebetween and transmit the received power to the lamp part 160. The plurality of secondary windings T1 to TN may have the same winding start point as that of the primary winding Tp.

Here, the plurality of secondary windings T1 to TN may transmit the power to different lamps arrayed in the lamp part 160, respectively in the positive half-cycle and the negative half-cycle. That is, the plurality of secondary windings T1 to TN may transmit the power to odd-numbered lamps of the lamp part 160 in the positive half-cycle and transmit the power to even-numbered lamps of the lamp part 160 in the negative half-cycle. Preferably, the lamp part 160 may include an even number of lamps.

The current balance between the positive half-cycle and the negative half-cycle transmitted by the plurality of secondary windings T1 to TN may be achieved according to a charge balance law of the plurality of capacitors C1 to CN. In this regard, the plurality of secondary windings T1 to TN and the plurality of capacitors C1 to CN may be electrically connected to one another in one-to-one correspondence.

The path supply part 150 may supply a power transmission path for the plurality of secondary windings T1 to TN of the transformer T. In order to supply the path, the path supply part 150 may include first to third diode groups 151, 152 and 153, each of which may include a plurality of diodes.

A plurality of diodes of the first diode group 151 may be electrically connected to a plurality of lamps of the lamp part 160 in one-to-one correspondence. That is, each of the plurality of diodes of the first diode group 151 may include a cathode electrically connected to one end of a corresponding lamp among the plurality of lamps of the lamp part 160.

A plurality of diodes of the second diode group 152 may be connected in series to the plurality of diodes of the first diode group 151 in one-to-one correspondence. A plurality of diodes of the third diode group 153 may be connected in series to the plurality of diodes of the second diode group 152 in one-to-one correspondence.

That is, each of the plurality of diodes of the second diode group 152 may include a cathode electrically connected to an anode of a corresponding diode among the plurality of diodes of the first diode group 151. Each of the plurality of diodes of the third diode group 153 may include a cathode electrically connected to an anode of a corresponding diode among the plurality of diodes of the second diode group 152, and an anode connected to a ground.

The first to third diode groups 151 to 153 of the path supply part 150 may be electrically connected to the plurality of secondary windings T1 to TN of the transformer T and the plurality of capacitors C1 to CN in order to supply a power transmission path to the current balance part 140.

The odd-numbered secondary windings T1, T3, . . . , TN-1 among the plurality of secondary windings T1 to TN of the single transformer T may be electrically connected between anodes of adjacent diodes among the plurality of diodes of the first diode group 151, and the even-numbered secondary windings T2, T4, . . . , TN among the plurality of secondary windings T1 to TN may be electrically connected between anodes of adjacent diodes among the plurality of diodes of the second diode group 152.

More specifically, a first secondary winding T1 among the plurality of secondary windings T1 to TN is electrically connected between an anode of a first diode 151-1 and an anode of a second diode 151-2 among the plurality of diodes of the first diode group 151. At this time, a first capacitor C1 among the plurality of capacitors C1 to CN is electrically connected between the first secondary winding T1 and the anode of the second diode 151-2.

A second secondary winding T2 among the plurality of secondary windings T1 to TN is electrically connected between an anode of a second diode 152-2 and an anode of a third diode 152-3 among the plurality of diodes of the second diode group 152. A second capacitor C2 among the plurality of capacitors C1 to CN is electrically connected between the second secondary winding T2 and the third diode 152-3. Subsequently, the rest of the plurality of secondary windings T3 to TN-1 and the rest of the plurality of capacitors. C3 to CN-1 may be connected to the plurality of diodes of the first diode group 151 or the second diode group 152 by repeating the above-described connective relationships therebetween.

An N-th secondary winding TN is electrically connected between an anode of an N-th diode 152-N and an anode of a first diode 152-1 among the plurality of diodes of the second diode group 152. An N-th capacitor CN is electrically connected between the N-th secondary winding TN and the first diode 152-1.

The lamp part 160 may include a plurality of lamps LED1 to LEDN, each of which may be a Light Emitting Diode (LED).

Figure 2:
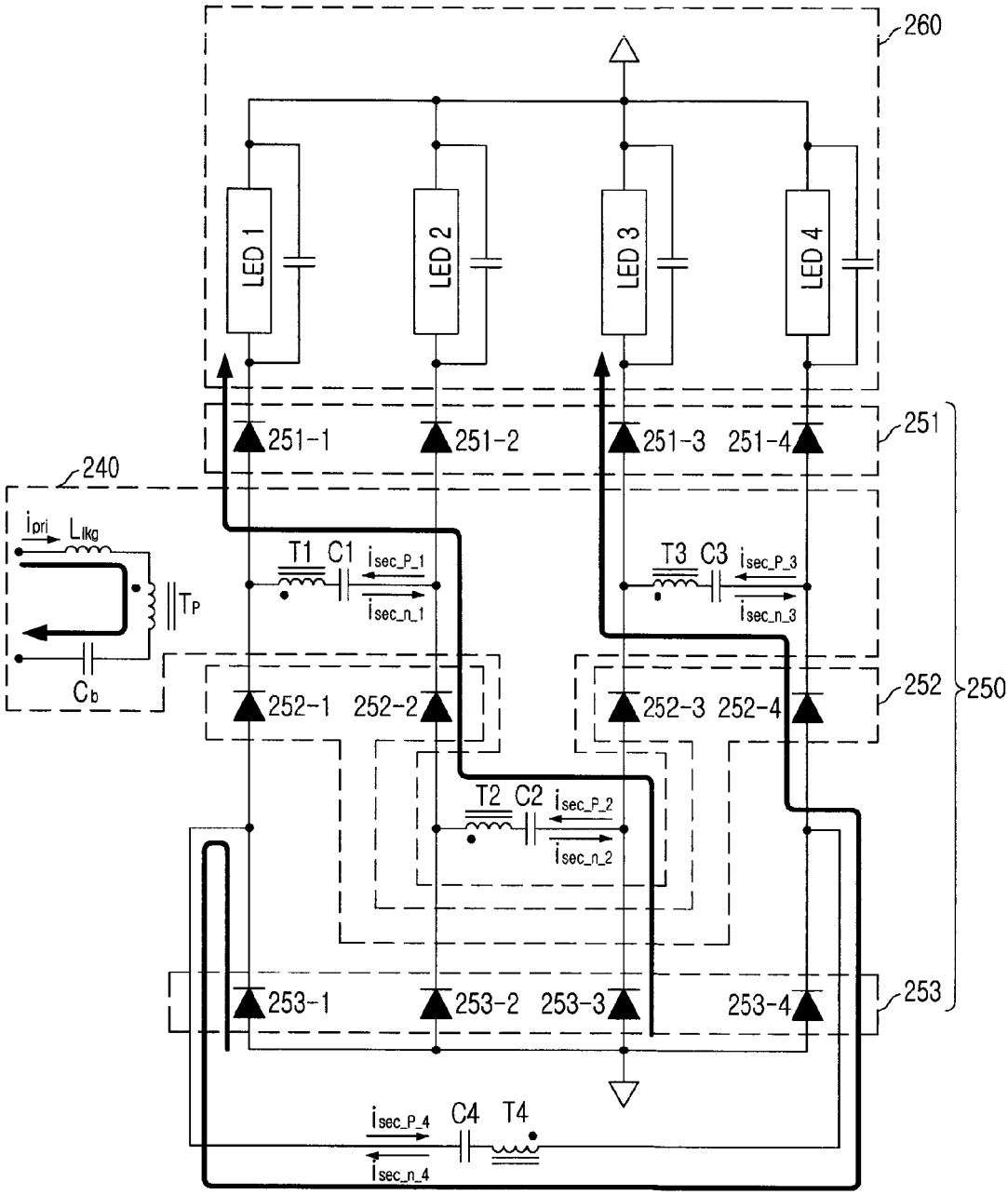
FIGS. 2 and 3 illustrate current flows for explaining current balance in a backlight unit driver according to an exemplary embodiment of the present invention.
Figure 3:
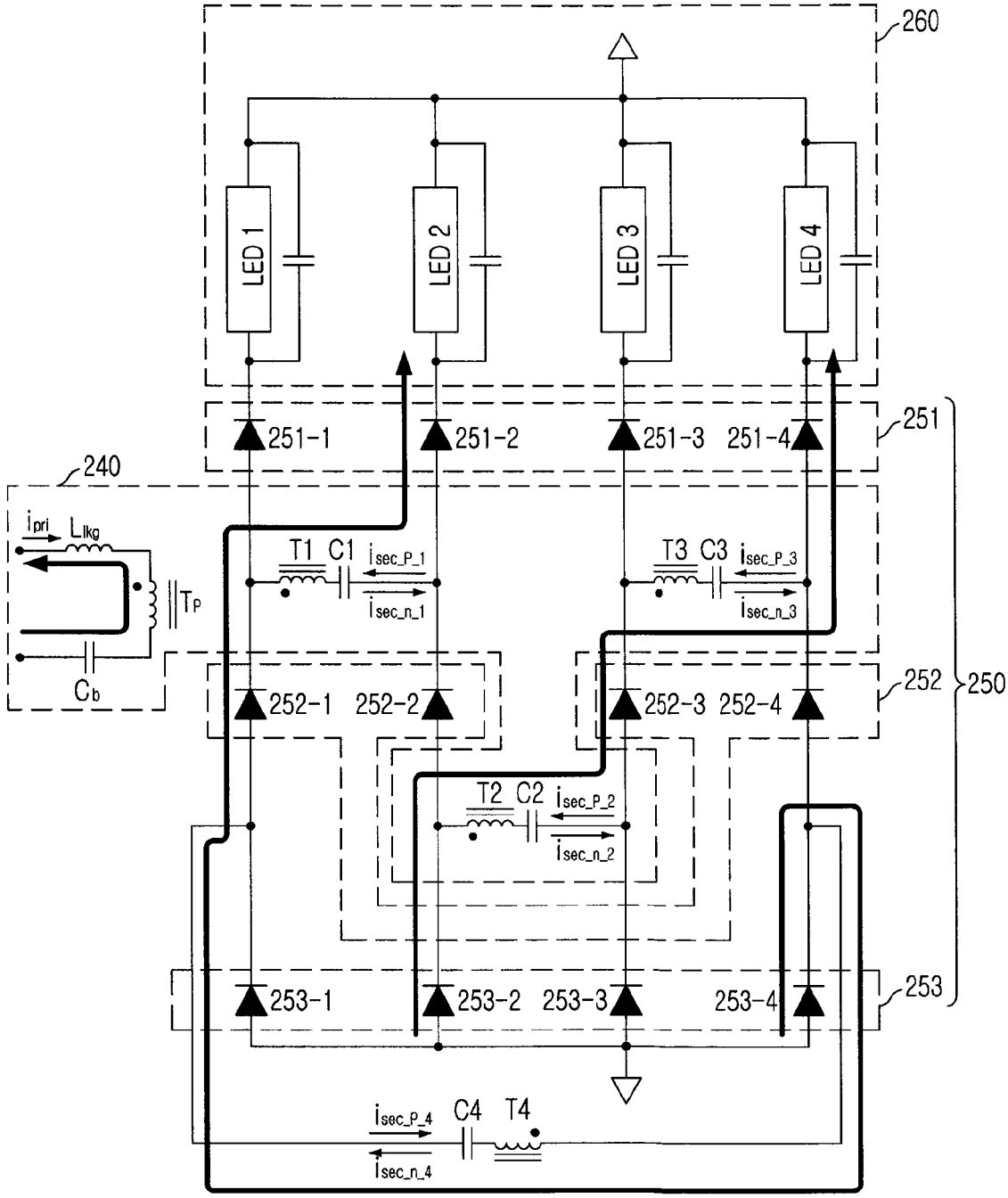

FIGS. 2 and 3 illustrate current flows for explaining current balance in a backlight unit driver according to an exemplary embodiment of the present invention. For convenience of explanation, a backlight unit driver of the present invention is configured in such a manner that a lamp part 260 includes four lamps LED1 to LED4, and accordingly, first to fourth secondary windings T1 to T4 and first to fourth capacitors C1 to C4 are employed, and each of first to third diode groups 251 to 253 includes first to fourth diodes 251-1 to 251-4, 252-1 to 252-4, and 253-1 to 253-4, respectively. However, the configuration for the backlight unit driver of the present invention is not limited thereto.

When a current $i_{pri}$ flows through a primary winding Tp of a single transformer T in the direction of the arrow depicted in FIG. 2 during a positive half-cycle of a switched power transmitted from an inverter part, first and third diodes 251-1 and 251-3 of the first diode group 251, second and fourth diodes 252-2 and 252-4 of the second diode group 252, and first and third diodes 253-1 and 253-3 of the third diode group 253 are turned on since the winding start point of the first to fourth secondary windings T1 to T4 is the same as that of the primary winding Tp, so that the power is supplied to first and third lamps LED1 and LED3.

At this time, the current may be represented by the following Formula 1.

$$i_{sec_P_1}=i_{sec_P_2}=i_{LED1}, i_{sec_P_3}=i_{sec_P_4}=i_{LED3} \quad \text{Formula 1}$$

In contrast, as shown in FIG. 3, when a current $i_{pri}$ flows through a primary winding Tp of a single transformer T in the direction of the arrow opposite to the direction of the arrow depicted in FIG. 2 during a negative half-cycle of a switched power transmitted from an inverter part, second and fourth diodes 251-2 and 251-4 of the first diode group 251, first and third diodes 252-1 and 252-3 of the second diode group 252, and second and fourth diodes 253-2 and 253-4 of the third diode group 253 are turned on since the winding start point of the first to fourth secondary windings T1 to T4 is the same as that of the primary winding Tp, so that the power is supplied to second and fourth lamps LED2 and LED4.

At this time, the current may be represented by the following Formula 2.

$$i_{sec_N_1}=i_{sec_N_4}=i_{LED2}, i_{sec_N_2}=i_{sec_N_3}=i_{LED4} \quad \text{Formula 2}$$

Here, the secondary windings T1 to T4 are electrically connected to the capacitors C1 to C4, respectively. Pursuant to the charge balance law, an average value of a DC offset in the entirety of current is set to '0,' so the following Formula 3 may be established.

$$i_{sec_P_1}=i_{sec_N_1},\ i_{sec_P_2}=i_{sec_N_2},\ i_{sec_P_3}=i_{sec_N_3},\ i_{sec_P_4}=i_{sec_N_4} \quad \text{Formula 3}$$

In view of Formulas 1 to 3, the current supplied to the first to fourth lamps may be controlled to be the same magnitude, as represented by the following Formula 4.

$$\langle i_{sec_P_1}\rangle=\langle i_{sec_N_1}\rangle=\langle i_{sec_P_2}\rangle=\langle i_{sec_N_2}\rangle=\langle i_{sec_P_3}\rangle=\langle i_{sec_N_3}\rangle=\langle i_{sec_P_4}\rangle=\langle i_{sec_N_4}\rangle=i_{LED\ 1}=i_{LED\ 2}=i_{LED\ 3}=i_{LED\ 4} \quad \text{Formula 4}$$

When this is applied to the configuration of the backlight unit driver having the first to N-th lamps LED1 to LEDN of FIG. 1, the current supplied to the entirety of the lamps may be controlled to be the same magnitude, as represented by the following Formula 5.

$$\langle i_{sec_P_k}\rangle=\langle i_{sec_N_k}\rangle=i_{LED,\ k}\ k=1, 2, \ldots n \quad \text{Formula 5}$$

As described above, unlike the related art, the present invention does not require a complex driving circuit and a DC/DC converter for constant current controlling and current balancing in power supply to lamps, especially LEDs, and accordingly, it has a reduction of production costs and is advantageous in miniaturization due to an increase in power density through a reduction of circuit volume. Also, it is configured of passive devices, so the reliability thereof may be improved.

As set forth above, according to exemplary embodiments of the invention, there is no need for a complex balancing circuit in order to achieve the current balancing of lamps employed in a backlight unit. The present invention uses a single transformer to supply a driving power to multi-channel lamps and achieves the constant current control and current balance of the driving power supplied to each lamp. Particularly, the present invention supplies a driving power to multi-channel LED lamps by employing a single transformer, rather than a DC/DC converter and a controller necessary for the constant current control of the LED lamps employed in the backlight unit, whereby an increase in power conversion efficiency and a reduction in production costs and product volume may be achieved. By supplying the driving power to the multi-channel LED lamps using the single transformer, the current balance of the driving power supplied to each LED lamp is maintained to thereby have an effect of constant current control with regard to the current flowing through each LED lamp.

While the present invention has been shown and described in connection with the exemplary embodiments, it will be apparent to those skilled in the art that modifications and variations can be made without departing from the spirit and scope of the invention as defined by the appended claims.

What is claimed is:

1. A backlight unit driver comprising:

an inverter part switching an input power to supply a power having a preset cycle;

a lamp part including a plurality of lamps receiving the switched power from the inverter part and emitting light; and a current balance part electrically connected between the inverter part and the lamp part and transmitting the switched power from the inverter part to the plurality of lamps of the lamp part such that a half cycle power of the switched power is transmitted to odd-numbered lamps of the lamp part and the other half cycle power of the switched power is transmitted to even-numbered lamps of the lamp part to maintain current balance according to a charge balance law between the half cycle power and the other half cycle power of the switched power.

2. The backlight unit driver of claim 1, wherein the current balance part comprises:

a single transformer including a primary winding receiving the switched power from the inverter part and a plurality of secondary windings each receiving the switched power from the primary winding by electromagnetic coupling with the primary winding and transmitting the received power to a corresponding lamp; and a plurality of capacitors maintaining current balance according to the charge balance law by being electrically connected to the plurality of secondary windings, respectively.

3. The backlight unit driver of claim 2, further comprising a path supply part supplying a conductive path for a power transmitted from the current balance part to the plurality of lamps of the lamp part according to a half cycle of the switched power from the inverter part.

4. The backlight unit driver of claim 3, wherein the path supply part comprises:

a first diode group including a plurality of diodes each having a cathode connected to one end of a corresponding lamp among the plurality of lamps of the lamp part;

a second diode group being in one-to-one correspondence with the plurality of diodes of the first diode group and including a plurality of diodes each having a cathode connected to an anode of a corresponding diode among the plurality of diodes of the first diode group; and a third diode group being in one-to-one correspondence with the plurality of diodes of the second diode group and including a plurality of diodes each having a cathode connected to an anode of a corresponding diode among the plurality of diodes of the second diode group and an anode connected to a ground.

5. The backlight unit driver of claim 4, wherein an odd-numbered secondary winding, among the plurality of secondary windings of the single transformer, is electrically connected between an anode of the same odd-numbered diode as the odd-numbered secondary winding and an anode of an even-numbered diode subsequent to the odd-numbered diode among the plurality of diodes of the first diode group, an even-numbered secondary winding, among the plurality of secondary windings of the single transformer, is electrically connected between an anode of the same even-numbered diode as the even-numbered secondary winding and an anode of an odd-numbered diode subsequent to the even-numbered diode among the plurality of diodes of the second diode group, and a final secondary winding, among the plurality of secondary windings of the single transformer, is electrically connected between an anode of a final diode and an anode of a first diode among the plurality of diodes of the second diode group.

6. The backlight unit driver of claim 5, wherein a first secondary winding, among the plurality of secondary windings of the single transformer, is electrically connected between an anode of a first diode and an anode of a second diode among the plurality of diodes of the first diode group, a second secondary winding, among the plurality of secondary windings of the single transformer, is electrically connected between an anode of a second diode and an anode of a third diode among the plurality of diodes of the second diode group, a third secondary winding, among the plurality of secondary windings of the single transformer, is electrically connected between an anode of a third diode and an anode of a fourth diode among the plurality of diodes of the first diode group, and a fourth secondary winding, among the plurality of secondary windings of the single transformer, is electrically connected between an anode of a fourth diode and an anode of a first diode among the plurality of diodes of the second diode group.

7. The backlight unit driver of claim 6, wherein a first capacitor among the plurality of capacitors is electrically connected between one end of the first secondary winding and the anode of the second diode of the first diode group, a second capacitor among the plurality of capacitors is electrically connected between one end of the second secondary winding and the anode of the third diode of the second diode group, a third capacitor among the plurality of capacitors is electrically connected between one end of the third secondary winding and the anode of the fourth diode of the first diode group, and a fourth capacitor among the plurality of capacitors is electrically connected between one end of the fourth secondary winding and the anode of the first diode of the second diode group.

8. The backlight unit driver of claim 5, wherein an odd-numbered capacitor among the plurality of capacitors is electrically connected between one end of the same odd-numbered secondary winding as the odd-numbered capacitor and an anode of an even-numbered diode subsequent to the odd-numbered secondary winding of the first diode group, an even-numbered capacitor among the plurality of capacitors is electrically connected between one end of the same even-numbered secondary winding as the even-numbered capacitor and an anode of an odd-numbered diode subsequent to the even-numbered secondary winding of the second diode group, and a final capacitor of the plurality of capacitors is electrically connected between one end of the final secondary winding and the anode of the first diode of the second diode group.

9. The backlight unit driver of claim 2, wherein the primary winding and the plurality of secondary windings of the single transformer have the same winding start point.

10. The backlight unit driver of claim 2, wherein the plurality of lamps of the lamp part are in even number, and the plurality of secondary windings of the single transformer are in even number.

11. The backlight unit driver of claim 1, wherein the inverter part switches the input power in a half-bridge, push-pull, or full-bridge configuration.

12. The backlight unit driver of claim 1, further comprising a rectification part rectifying a common alternating current (AC) power, and a power factor correction (PFC) part correcting a power factor of the rectified power and supplying the corrected power to the inverter part as the input power.

13. The backlight unit driver of claim 1, wherein the plurality of lamps of the lamp part are light emitting diodes (LEDs).

* * * * *